US008810120B2

(12) United States Patent
Sumoyama et al.

(10) Patent No.: US 8,810,120 B2
(45) Date of Patent: Aug. 19, 2014

(54) SPARK PLUG

(75) Inventors: Daisuke Sumoyama, Nagoya (JP); Osamu Yoshimoto, Inazawa (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 14/232,639

(22) PCT Filed: Apr. 17, 2012

(86) PCT No.: PCT/JP2012/002637

§ 371 (c)(1),
(2), (4) Date: Jan. 14, 2014

(87) PCT Pub. No.: WO2013/018252

PCT Pub. Date: Feb. 7, 2013

(65) Prior Publication Data

US 2014/0159564 A1 Jun. 12, 2014

(30) Foreign Application Priority Data

Jul. 29, 2011 (JP) ..... 2011-166387

(51) Int. Cl.
*H01T 13/20* (2006.01)

(52) U.S. Cl.
CPC ..... *H01T 13/20* (2013.01)
USPC ..... 313/141

(58) Field of Classification Search
USPC ..... 313/118–145
See application file for complete search history.

(56) References Cited

U.S. PATENT DOCUMENTS

| | | | | |
|---|---|---|---|---|
| 4,488,081 | A | 12/1984 | Kondo et al. | 313/141 |
| 4,670,684 | A | 6/1987 | Kagawa et al. | 313/141 |
| 2009/0302732 | A1 | 12/2009 | Lykowski | 313/141 |

FOREIGN PATENT DOCUMENTS

| | | | |
|---|---|---|---|
| JP | 58-59581 | 4/1983 | H01T 13/20 |
| JP | 59-160988 | 9/1984 | H01T 13/20 |
| JP | 61-135083 | 6/1986 | H01T 13/39 |
| JP | 61-230282 | 10/1986 | H01T 13/39 |
| JP | 61-230283 | 10/1986 | H01T 13/39 |
| JP | 2005-150011 | 6/2005 | H01T 13/20 |
| JP | 2011-517830 | 6/2011 | H01T 13/39 |

OTHER PUBLICATIONS

Form PCT/ISA/210—Int'l Search Report (from corresponding Int'l Patent App. No. PCT/JP2012/002637—2 pages (English version only).

*Primary Examiner* — Donald Raleigh
(74) *Attorney, Agent, or Firm* — Kusner & Jaffe

(57) ABSTRACT

A spark plug having a center electrode; a ground electrode provided so as to form a gap between the ground electrode and the center electrode; and a tip provided on at least one of a distal end portion of the ground electrode and a front end portion of the center electrode, the end portions facing each other, characterized in that the tip contains an element group M (M consists of at least one species of Pt and Rh) in an amount of 3 mass % to 35 mass %, and an element group L (L consists of at least one species of Ir, Ru, and Pd) in an amount of 0 mass % to 15 mass %; the total amount of the element group M and the element group L is at most 35 mass %; and the total amount of Ni, the element group M, and the element group L is at least 94 mass %.

7 Claims, 3 Drawing Sheets

SPARK PLUG

FIELD OF THE INVENTION

The present invention relates to a spark plug, and more particularly to a spark plug in which a tip is provided on at least one of a ground electrode and a center electrode.

BACKGROUND OF THE INVENTION

Generally, a spark plug used for ignition in an internal combustion engine (e.g., an automobile engine) includes a tubular metallic shell; a tubular insulator provided in an inner hole of the metallic shell; a center electrode provided in an inner hole of the insulator on the front end side thereof; and a ground electrode, one end of which is bonded to the front end of the metallic shell and the other end of which forms a spark discharge gap with the center electrode. In the case where such a spark plug is provided in a combustion chamber of an internal combustion engine, when spark discharge occurs at the spark discharge gap formed between the front end portion of the center electrode and the distal end portion of the ground electrode, a fuel charged in the combustion chamber is combusted.

Generally, an Ni alloy or the like is employed as a material for forming a ground electrode or a center electrode. Although an Ni alloy exhibits slightly poor oxidation resistance and erosion resistance, as compared with a noble metal alloy containing a noble metal (e.g., Pt or Ir) as a main component, an Ni alloy is suitable for use as a material for forming a ground electrode or a center electrode, since it is less expensive than a noble metal. However, in association with a recent tendency that higher temperature is required in a combustion chamber, when spark discharge occurs between a distal end portion of a ground electrode and a front end portion of a center electrode, each of the electrodes being formed of an Ni alloy or the like, spark erosion is likely to occur at the distal end portion of the ground electrode or the front end portion of the center electrode, the end portions facing each other. Thus, there has been proposed a method in which tips are provided on a distal end portion of a ground electrode and on a front end portion of a center electrode, the end portions facing each other, and spark discharge is caused to occur between the tips, to thereby improve the erosion resistances of the ground electrode and the center electrode. In many cases, these tips are formed of a material containing, as a main component, a noble metal exhibiting excellent oxidation resistance and erosion resistance.

For example, Japanese Patent Application Laid-Open (kokai) No. S59-160988 describes a spark plug "including tips formed of a Pt—Ni alloy material containing Ni (5 to 23 wt. %) and Pt (balance)" (see claim 2 of Japanese Patent Application Laid-Open (kokai) No. S59-160988), which spark plug is provided for achieving the following object; i.e., "to further improve the high temperature resistance of a spark plug including noble metal tips provided on spark discharge surfaces of a center electrode and an outer electrode" (see Japanese Patent Application Laid-Open (kokai) No. S59-160988, page 1, right column, lines 13 to 16).

Japanese Patent Application Laid-Open (kokai) No. S61-135083 describes "a spark plug including a bonded spark discharge portion formed of a Pt—Ni alloy, or a spark plug including a spark discharge portion formed of a Pt alloy exhibiting excellent erosion resistance, and an intermediate layer formed of a Pt—Ni alloy and provided between the Pt alloy and a matrix metal, characterized in that the Pt—Ni alloy is an alloy material containing Ni (5 to 40 wt. %), Pt (95 to 60 wt. %), and one or two metal oxides of Re, Y, Zr, Hf, Al, Ti, and La (0.02 to 1 part by weight), the metal oxide(s) being dispersed in the alloy material" (see claim 1 of Japanese Patent Application Laid-Open (kokai) No. S61-135083), which spark plug is provided for achieving the following object; i.e., "to provide a spark plug exhibiting excellent durability and prolonged service life" (see Japanese Patent Application Laid-Open (kokai) No. 561-135083, page 2, upper left column, lines 11 to 13).

In recent years, an increasing demand has arisen for resource saving and cost reduction of spark plugs. Conceivable means for meeting such a demand is to reduce the amount of a noble metal (i.e., a rare and expensive resource) contained in a tip formed of the aforementioned noble metal alloy containing the noble metal as a main component. However, when the noble metal content of the tip is reduced, as described hereinbelow, a protrusion is formed on the tip due to various causes, and the protrusion may impede maintenance of erosion resistance and a spark discharge gap.

In view of the foregoing, an advantage of the present invention is to provide a spark plug including a tip provided on at least one of a center electrode and a ground electrode, which spark plug, even when the noble metal content of the tip is reduced as compared with conventional cases, exhibits erosion resistance and durability, since a spark discharge gap is maintained between the center electrode and the ground electrode.

SUMMARY OF THE INVENTION

In accordance with the present invention, there is provided (1) a spark plug comprising a center electrode; a ground electrode provided so as to form a gap between the ground electrode and the center electrode; and a tip provided on at least one of a distal end portion of the ground electrode and a front end portion of the center electrode, the end portions facing each other, characterized in that the tip contains an element group M (M consists of at least one species of Pt and Rh) in an amount of 3 mass % to 35 mass %, and an element group L (L consists of at least one species of Ir, Ru, and Pd) in an amount of 0 mass % to 15 mass %; the total amount of the element group M and the element group L is at most 35 mass %; and the total amount of Ni, the element group M, and the element group L is at least 94 mass %.

In accordance with another aspect of the present invention, there is provided a spark plug (1) as described above, wherein (2) the tip contains an element group S (S consists of at least one species of Si, Al, Ti, Cr, and Mn) in an amount of 0.2 mass % to 6 mass %.

In accordance with another aspect of the present invention, there is provided a spark plug as described above, wherein (3) the tip contains the element group L in an amount of 1 mass % to 10 mass %.

In accordance with another aspect of the present invention, there is provided a spark plug as described above, wherein (4) the tip contains the element group M in an amount of 5 mass % to 30 mass %, and the total amount of the element group M and the element group L is at most 30 mass %.

In accordance with another aspect of the present invention, there is provided a spark plug as described above, wherein (5) the tip contains the element group S in an amount of 0.5 mass % to 3 mass %.

In accordance with another aspect of the present invention, there is provided a spark plug as described above, wherein (6) the tip is bonded to a surface of the ground electrode and/or the center electrode (hereinafter may be referred to as the "electrode") without the intervention of a fused portion formed through fusion between the tip and the electrode, or at least a portion of the tip is bonded to the electrode surface with the intervention of the fused portion, and when the electrode to which the tip is bonded is cut along a plane flush with the electrode surface, a region of the cut surface defined by a boundary line between the electrode and the tip and/or the fused portion has an area S of at least 0.7 $mm^2$.

In accordance with another aspect of the present invention, there is provided a spark plug as described above, wherein (7) the area S is at least 1.2 $mm^2$.

According to the present invention, since the tip contains a specific amount of the element group S, formation of a protrusion can be further suppressed. Therefore, there can be provided a spark plug exhibiting excellent erosion resistance and further excellent durability, in which a spark discharge gap can be maintained.

According to the present invention, even when the noble metal content of the tip is reduced as compared with conventional cases, since the tip contains specific amounts of Ni, the element group M, and optionally the element group L as described above, erosion resistance is achieved, and formation of a protrusion can be suppressed. When formation of a protrusion is suppressed, overheating of the tip, which would otherwise occur due to the protrusion, is suppressed, whereby acceleration of erosion can be suppressed. In addition, a reduction in spark discharge gap caused by the protrusion can be suppressed. Therefore, there can be provided a spark plug exhibiting erosion resistance and durability, in which a spark discharge gap can be maintained.

According to the present invention, since the aforementioned area S is at least 0.7 $mm^2$; in particular, 1.2 $mm^2$, heat received by the tip through spark discharge is readily transferred to the ground electrode and/or the center electrode, whereby overheating of the tip can be suppressed. Thus, formation of a protrusion, which would otherwise occur due to overheating of the tip, is suppressed. Therefore, there can be provided a spark plug exhibiting excellent erosion resistance and further excellent durability, in which a spark discharge gap can be maintained.

BRIEF DESCRIPTION OF THE DRAWINGS

FIG. 3(*b*) shows a cross section of the tip shown in FIG. 3(*a*) as formed by cutting the tip along a plane flush with the surface of the ground electrode to which the tip is bonded.

DETAILED DESCRIPTION OF PREFERRED EMBODIMENTS

The spark plug of the present invention includes a center electrode; a ground electrode provided so as to form a gap between the ground electrode and the center electrode; and a tip provided on at least one of the ground electrode and the center electrode. No particular limitation is imposed on the configuration of a portion other than a main portion of the spark plug of the present invention, so long as the main portion of the spark plug has the aforementioned configuration. That is, the portion other than the main portion may have any known configuration.

Figure 1:
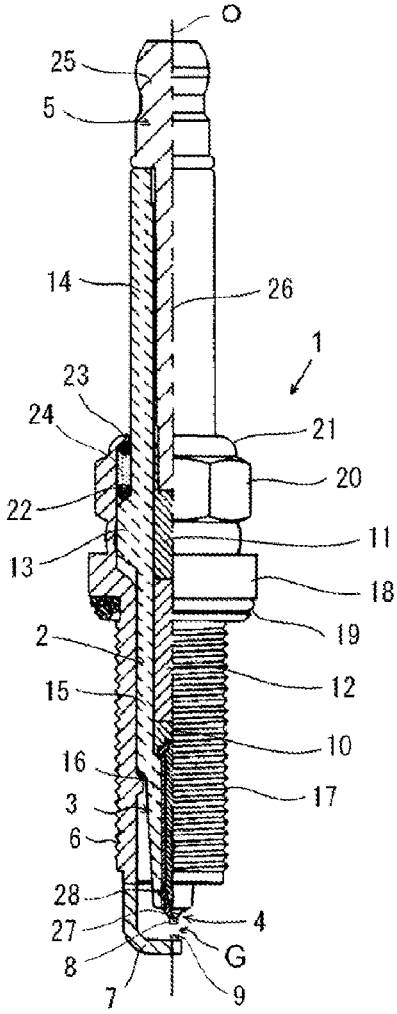
FIG. 1 is a partially cross-sectional view of the entirety of a spark plug according to one embodiment of the present invention.

FIG. 1 shows one embodiment of the spark plug of the first invention. FIG. 1 is a partially cross-sectional view of the entirety of a spark plug 1, which is one embodiment of the spark plug of the present invention. In the following description, the lower side of FIG. 1 is referred to as the front end side of an axis O, and the upper side of FIG. 1 is referred to as the rear end side of the axis O.

As shown in FIG. 1, the spark plug 1 includes a generally circular columnar insulator 3 having an axial hole 2 extending in the direction of the axis O; a generally rod-shaped center electrode 4 provided in the axial hole 2 on the front end side; a terminal shell 5 provided in the axial hole 2 on the rear end side; a generally circular columnar metallic shell 6 which holds the insulator 3; a ground electrode 7, one end of which faces the front end surface of the center electrode 4 via a spark discharge gap G, and the other end of which is bonded to the frond end surface of the metallic shell 6; and a tip 8 or 9 provided on at least one of the center electrode 4 and the ground electrode 7.

The insulator 3 includes the center electrode 4 provided in the axial hole 2 on the front end side; the terminal shell 5 provided on the rear end side; sealing bodies 10 and 11 provided between the center electrode 4 and the terminal shell 5 for fixing the center electrode 4 and the terminal shell 5 in the axial hole 2; and a resistor 12 for reducing propagated noise. The insulator 3 has, in the vicinity of its center in the direction of the axis O, a flange portion 13 which is formed so as to protrude in a radial direction. The insulator 3 has, on the rear end side of the flange portion 13, a rear-end-side body portion 14 which is formed so as to accommodate the terminal shell 5 and to insulate the terminal shell 5 from the metallic shell 6. The insulator 3 has, on the front end side of the flange portion 13, a front-end-side body portion 15 which accommodates the resistor 12, and has, on the front end side of the front-end-side body portion 15, an elongated leg portion 16 which accommodates the center electrode 4 and has an outer diameter smaller than that of the front-end-side body portion 15. The insulator 3 is fixed to the metallic shell 6 such that the front end portion of the insulator 3 projects from the front end surface of the metallic shell 6. The insulator 3 is preferably formed of a material exhibiting mechanical strength, thermal strength, and electrical strength. Examples of such a material include a sintered ceramic material mainly containing alumina.

The metallic shell 6 has a circular columnar shape, and is formed so as to hold the insulator 3 provided therein. The metallic shell 6 has a threaded portion 17 on an outer peripheral surface on the front end side. By means of the threaded portion 17, the spark plug 1 is attached to a non-illustrated cylinder head of an internal combustion engine. A flange-like gas sealing portion 18 is formed on the rear end side of the threaded portion 17, and a gasket 19 is fitted between the gas sealing portion 18 and the threaded portion 17. A tool engagement portion 20 for engagement of a tool (e.g., a spanner or a wrench) is formed on the rear end side of the gas sealing portion 18, and a crimp portion 21 is formed on the rear end side of the tool engagement portion 20. Ring-shaped packings 22 and 23 and talc 24 are provided in an annular space defined by the crimp portion 21, the inner peripheral surface of the tool engagement portion 20, and the outer peripheral surface of the insulator 3, such that the insulator 3 is fixed to the metallic shell 6. The metallic shell 6 may be formed of an electrically conductive steel material such as low-carbon steel.

The terminal shell 5 serves as a terminal for applying, to the center electrode 4 from the outside, a voltage employed for spark discharge between the center electrode 4 and the ground electrode 7. The terminal shell 5 has a flange-like exposed portion 25 which has an outer diameter greater than the inner diameter of the axial hole 2, and which is provided outside the axial hole 2 such that a portion of the exposed portion 25 abuts the rear end surface in the direction of the axis O. The terminal shell 5 also has a generally circular columnar portion 26 which extends from the front end (in the direction of the axis O) of the exposed portion 25 toward the front end side, and which is accommodated in the axial hole 2. The terminal shell 5 may be formed of a metal material such as low-carbon steel.

The generally rod-shaped center electrode 4 is formed of an outer layer 27, and a core 28 which is concentrically buried in an axial core portion of the outer layer 27. The center electrode 4 is fixed in the axial hole 2 of the insulator 3 such that the front end of the electrode 4 projects from the front end surface of the insulator 3, and the center electrode 4 is insulated from the metallic shell 6. The core 28 is formed of a material having thermal conductivity higher than that of the material of the outer layer 27. Examples of such a material include Cu, a Cu alloy, Ag, an Ag alloy, and pure Ni. The outer layer 27 may be formed of any known material employed for forming the center electrode 4; for example, an Ni alloy.

The ground electrode 7 is formed so as to have, for example, a generally rectangular columnar shape. The ground electrode 7 is formed such that one end portion thereof is bonded to the front end surface of the metallic shell 6; the electrode 7 is bent in a generally L-shape at a middle portion thereof; and the other end portion of the electrode 7 faces the front end portion of the center electrode 4 via the spark discharge gap G. The ground electrode 7 may be formed of any known material employed for forming the ground electrode 7; for example, an Ni alloy. The spark discharge gap G of the spark plug 1 according to the present embodiment corresponds to the shortest distance between the tip 8 provided on the front end portion of the center electrode 4 and the tip 9 provided on the distal end portion of the ground electrode 7, and the spark discharge gap G is generally adjusted to 0.3 to 1.5 mm. The tip 8 or 9 may be provided on at least one of the distal end portion of the ground electrode 7 and the front end portion of the center electrode 4, the end portions facing each other. When, for example, the tip 9 is provided on the distal end portion of the ground electrode 7, whose temperature is more likely to become higher, and the tip 8 is not provided on the front end portion of the center electrode 4, the spark discharge gap G corresponds to the shortest distance between the facing surfaces of the center electrode 4 and the tip 9 provided on the ground electrode 7.

The tip 8 or 9 of the spark plug 1 of the present invention contains an element group M (M consists of at least one species of Pt and Rh) in an amount of 3 mass % to 35 mass %, and an element group L (L consists of at least one species of Ir, Ru, and Pd) in an amount of 0 mass % to 15 mass %. The total amount of the element group M and the element group L is 3 mass % to 35 mass %, and the total amount of Ni, the element group M, and the element group L is at least 94 mass %. The amount of Ni for satisfying these conditions is 59 mass % to 97 mass %.

In the tip 8 or 9, the amount of an expensive noble metal can be reduced by increasing the amount of Ni in place of the noble metal, which is generally employed as a main component.

The element group M is a material exhibiting excellent oxidation resistance and spark erosion resistance in a high-temperature environment. Therefore, it is presumed that in the case where the spark plug 1 is employed in an actual machine; i.e., the tip 8 or 9 is subjected to a cooling/heating cycle environment, when the amount of the element group M is increased, erosion resistance, which is evaluated by less reduction in volume of the tip 8 or 9, is improved. However, contrary to this presumption, it has been elucidated that in the case where the main component of the tip 8 or 9 is not the element group M, even when the amount of the element group M is increased, erosion resistance is not necessarily improved. In the case where the main component of the tip 8 or 9 is not the element group M, a protrusion may be formed on the tip. Due to formation of the protrusion, erosion of the tip may be accelerated, or difficulty may be encountered in maintaining the spark discharge gap G. In view of the foregoing, the present inventors have conducted extensive studies, and as a result have found that, as described above, when the amount of the element group M or the element group L, the total amount of the element group M and the element group L, and the total amount of Ni, the element group M, and the element group L fall within specific ranges, formation of a protrusion is suppressed, whereby erosion resistance is achieved and the spark discharge gap G can be maintained, and thus the spark plug 1 exhibits durability.

Figure 2:
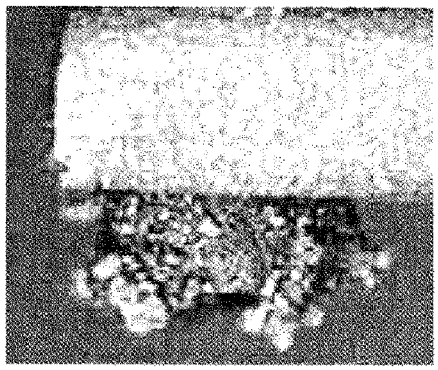
FIG. 2 is a photograph of a protrusion formed in a conventional spark plug.

When the amount of the element group M is less than 3 mass %, the effects of the element group M, which exhibits excellent oxidation resistance and spark erosion resistance, are not obtained, and thus the tip 8 or 9 exhibits poor erosion resistance. In addition, when the amount of the element group M is less than 3 mass %, such a protrusion as shown in FIG. 2 is likely to be formed on the tip 8 or 9, and the spark discharge gap G is reduced. When the spark discharge gap G is reduced, short circuit may occur, and occurrence of short circuit may cause accidental fire. When such a protrusion is formed, the area exposed to a high-temperature air layer is increased, and heat received by the tip 8 or 9 is less likely to be transferred to the ground electrode 7 and/or the center electrode 4, which promotes overheating of the tip 8 or 9. Overheating of the tip 8 or 9 accelerates erosion of the tip 8 or 9, resulting in poor erosion resistance.

Conceivably, the aforementioned protrusion is formed by the following mechanism. When the spark plug is mounted in an actual machine, since the temperature in the combustion chamber is repeatedly elevated and lowered, the tip 8 or 9 is subjected to a cooling/heating cycle environment. When the tip 8 or 9 is subjected to such a cooling/heating cycle environment, Ni (i.e., the main component of the tip 8 or 9) is likely to be oxidized or corroded at grain boundaries, and an oxide or a corrosion product is generated at the grain boundaries, whereby internal stress is likely to occur. Conceivably, when the temperature in the combustion chamber becomes high; i.e., the tip 8 or 9 is subjected to a high temperature, plastic deformation or creep deformation occurs so as to relax the stress. Conceivably, this deformation raises the surface of the tip 8 or 9 or causes projection of crystal grains from the surface of the tip 8 or 9, resulting in formation of a protrusion as shown in FIG. 2.

When the amount of the element group M is 3 mass % to 35 mass % (preferably 5 mass % to 30 mass %), since an element of the element group M is less likely to be oxidized or corroded, oxidation or corrosion of Ni is suppressed at grain boundaries. Thus, formation of a protrusion on the surface of the tip 8 or 9 is suppressed. When formation of a protrusion is suppressed, overheating of the tip 8 or 9, which is caused by the protrusion, is reduced, and thus erosion of the tip can be suppressed. Therefore, when the amount of the element group M is 3 mass % to 35 mass % (in particular, 5 mass % to 30 mass %), excellent erosion resistance is achieved and the spark discharge gap can be maintained, and thus the spark plug 1 exhibits durability.

When the amount of the element group M exceeds 35 mass %, such a protrusion as shown in FIG. 2 is likely to be formed on the tip 8 or 9. As described above, when such a protrusion is formed, erosion resistance is impaired, and the spark discharge gap G is reduced. Conceivably, such a protrusion is formed by a mechanism different from that in the case where the amount of the element group M is small. When the amount of the element group M increases, the absolute amount of oxidation or corrosion of Ni can be reduced. Meanwhile, oxidation or corrosion of Ni proceeds from the surface of the tip 8 or 9 in a depth direction. Since Ni is more likely to be oxidized or corroded than an element of the element group M, when Ni is selectively eroded, a layer containing an increased amount of the element group M (hereinafter the layer may be referred to as the "element-group-M-enriched layer") is formed even in the inside of the tip 8 or 9. The element-group-M-enriched layer is likely to be formed in the vicinity of grain boundaries of Ni, which is likely to be oxidized or corroded, and the element-group-M-enriched layer has a thermal expansion coefficient different from that of the matrix forming the tip 8 or 9 (i.e., the layer containing a large amount of Ni). Therefore, when formation of the element-group-M-enriched layer proceeds, stress occurs in the tip 8 or 9 which is subjected to a cooling/heating cycle environment. Conceivably, this stress raises the surface of the tip 8 or 9 or causes projection of crystal grains from the surface of the tip 8 or 9, resulting in formation of a protrusion as shown in FIG. 2. When the amount of the element group M is large, since the ductility of the tip 8 or 9 is reduced; i.e., the tip becomes fragile, cracking, etc. occur in the tip 8 or 9 due to the presence of the element-group-M-enriched layer. Thus, overheating of the tip 8 or 9 occurs from a cracked portion, and a protrusion is more likely to be formed.

The amount of the element group L is preferably at most 15 mass %, particularly preferably 1 mass % to 10 mass %. Since an element of the element group L has a melting point higher than that of Ni, when the element group L is incorporated in an appropriate amount, erosion resistance is improved. When the amount of the element group L exceeds 15 mass %, the ductility of the tip 8 or 9 is reduced; i.e., the tip becomes fragile, and thus cracking is likely to occur in the tip 8 or 9. Therefore, overheating of the tip 8 or 9 is likely to occur from a cracked portion, and a protrusion is likely to be formed. As described above, when the protrusion is formed, erosion of the tip 8 or 9 is likely to proceed, and difficulty is encountered in maintaining the spark discharge gap G.

In the case where the amount of the element group M is 3 mass % to 35 mass %, and the amount of the element group L is 0 mass % to 15 mass % (in particular, 1 mass % to 10 mass %), when the total amount of the element group M and the element group L is 3 mass % to 35 mass % (in particular, 4 mass % to 35 mass %), erosion resistance is improved, and the spark discharge gap can be maintained. In the case where the amount of the element group M is 5 mass % to 30 mass %, and the amount of the element group L is 0 mass % to 15 mass % (in particular, 1 mass % to 10 mass %), when the total amount of the element group M and the element group L is 5 mass % to 30 mass % (in particular, 6 mass % to 30 mass %), the erosion resistance of the tip 8 or 9 is further improved, and the spark discharge gap can be maintained. When the total amount of the element group M and the element group L is less than 3 mass %, for the same reason as in the case where the amount of the element group M is less than 3 mass %, a protrusion is likely to be formed on the tip 8 or 9, whereby erosion resistance is impaired, and difficulty is encountered in maintaining the spark discharge gap G. When the total amount of the element group M and the element group L exceeds 35 mass %, for the same reason as in the case where the amount of the element group M exceeds 35 mass %, a protrusion is likely to be formed. Therefore, erosion resistance is impaired, and difficulty is encountered in maintaining the spark discharge gap G.

The amount of the element group S incorporated is preferably 0.2 mass % to 6 mass %, particularly preferably 0.5 mass % to 3 mass %. When the element group S is incorporated in an appropriate amount, formation of a protrusion is suppressed. The reason why formation of a protrusion is suppressed through incorporation of an appropriate amount of the element group S is considered to be as follows. Since an element of the element group S is likely to react with oxygen, the element is preferentially oxidized at grain boundaries, to thereby form an oxide. The presence of an appropriate amount of the thus-formed oxide at grain boundaries can prevent diffusion, into the tip 8 or 9, of a corrosive element or oxygen contained in deposits of oil, uncombusted fuel, etc. Therefore, oxidation or corrosion of Ni can be suppressed, and thus formation of a protrusion can be suppressed.

When the amount of the element group S is 0.5 mass % to 3 mass %, formation of a protrusion can be further suppressed, which is preferred. When the amount of the element group S exceeds 6 mass %, the thermal conductivity of the tip 8 or 9 is reduced. Therefore, even when formation of a protrusion can be suppressed, erosion resistance may be impaired.

When the amount of the element group M is 5 mass % to 30 mass %, and the amount of the element group S is 0.5 mass % to 3 mass %, formation of a protrusion can be further suppressed, and thus erosion of the tip 8 or 9 can be reduced through suppression of overheating of the tip 8 or 9, resulting in maintenance of the spark discharge gap G, which is particularly preferred.

The tips 8 and 9 are provided on the surfaces (spark discharge occurs therebetween) of the center electrode 4 and the ground electrode 7, respectively. In the present embodiment, the tip 8 or 9 has a circular columnar shape. However, no particular limitation is imposed on the shape of the tip 8 or 9, and the tip may have any appropriate shape; for example, a circular columnar shape, a rectangular columnar shape, or a plate shape. The tip 8 or 9 may be bonded to the surface of the ground electrode 7 and/or the center electrode 4 through any appropriate welding technique. Alternatively, the tip 8 or 9 may be bonded to the ground electrode 7 and/or the center electrode 4 so that a portion of the tip is buried in a hole or notch provided in the electrode.

Figure 3A:
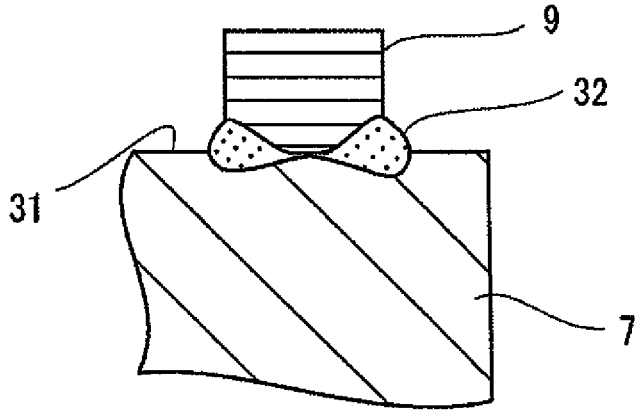
FIG. 3(*a*) is a cross-sectional view of a main portion of a ground electrode to which a tip is bonded.
Figure 3B:
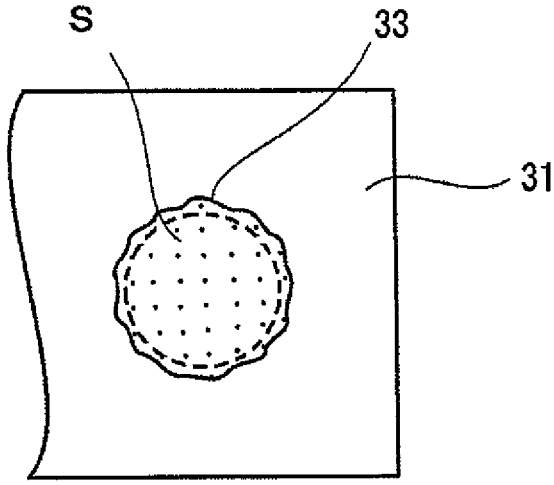

FIG. 3(*a*) is a cross-sectional view of a main portion of the ground electrode to which the tip is bonded. FIG. 3(*b*) shows a cross section of the tip shown in FIG. 3(*a*) as formed by cutting the tip along a plane flush with the surface of the ground electrode to which the tip is bonded. As shown in FIGS. 3(*a*) and 3(*b*), when the tip 9 is bonded to a surface 31 of the ground electrode 7 via a fused portion 32 formed through fusion between the tip 9 and the ground electrode 7, and the ground electrode 7 to which the tip 9 is bonded is cut along a plane flush with the surface 31, the area S of a region of the cut surface defined by a boundary line 33 between the fused portion 32 and the ground electrode 7 is preferably at least 0.7 $mm^2$, particularly preferably at least 1.2 $mm^2$. When the area S is at least 0.7 $mm^2$ (in particular, at least 1.2 $mm^2$), heat received by the tip 9 through spark discharge is readily transferred to the ground electrode 7, whereby overheating of the tip 9 can be suppressed. Thus, erosion resistance can be further improved, and formation of a protrusion on the tip 9 can be suppressed. FIG. 3(*a*) shows the case where the tip 9 is bonded to the ground electrode 7 via the fused portion 32. However, the tip 9 may be bonded directly to the ground electrode 7 without the intervention of the fused portion 32. In this case, the area S corresponds to the area of a region defined by a boundary line between the tip 9 and the ground electrode 7. Alternatively, a portion of the tip 9 may be bonded to the ground electrode 7 via the fused portion 32, and the remaining portion of the tip 9 may be bonded directly to the ground electrode 7 without the intervention of the fused portion 32. In this case, the area S corresponds to the area of a region defined by a boundary line between the tip 9 and the ground electrode 7 and a boundary line between the fused portion 32 and the ground electrode 7. Similar to the case of the tip 9 bonded to the ground electrode 7 shown in FIG. 3(*a*), in the case of the tip 8 bonded to the center electrode 4, the area S is preferably at least 0.7 $mm^2$, particularly preferably at least 1.2 $mm^2$.

A protrusion may also be formed on the fused portion 32, although the probability of protrusion formation on the fused portion 32 is lower than that on the surface of the tip 8 or 9. When a protrusion is formed on the fused portion 32, heat received by the tip 8 or 9 is less likely to be transferred to the ground electrode 7 and/or the center electrode 4 (hereinafter may be referred to as the "electrode"), and thus the tip 8 or 9 is overheated. Therefore, a protrusion is readily formed on the tip 8 or 9, and difficulty is encountered in maintaining erosion resistance and the spark discharge gap G. As described above, when the tip 8 or 9 contains an appropriate amount of the element group S, formation of a protrusion is suppressed. Meanwhile, when the tip 8 or 9 contains the element group S, an oxide is formed, and the oxide increases the stress inside the tip 8 or 9. Therefore, the tip 8 or 9 is likely to be removed from the electrode 4 or 7. When removal of the tip 8 or 9 from the electrode 4 or 7 proceeds, the front end portion of the tip 8 or 9 is overheated, and a protrusion is readily formed thereon. Thus, the element group S may fail to exhibit the effect of suppressing formation of a protrusion. When an oxide is formed only on the surface of the tip or at an inner portion of the tip in the vicinity of the tip surface, the element group S can exhibit the effect of suppressing oxidation or corrosion of Ni. Therefore, preferably, the structure of the tip is designed so that oxidation does not proceed to an inner deep portion of the tip; i.e., the oxidation degree is reduced to a minimum possible level. When the aforementioned area S is adjusted to at least 0.7 $mm^2$ (in particular, at least 1.2 $mm^2$), heat received by the tip is readily transferred to the ground electrode 7 and/or the center electrode 4, and thus the surface temperature of the tip is lowered, whereby oxidation of an element of the element group S inside the tip 8 or 9 is suppressed in the vicinity of the surface of the tip 8 or 9. Therefore, since an increase in internal stress can be prevented, removal of the tip can be prevented, and oxidation or corrosion of Ni can be suppressed. Thus, when the aforementioned area S is adjusted to a specific value, formation of a protrusion is suppressed, and removal of the tip 8 or 9 is prevented, whereby overheating of the tip 8 or 9 is suppressed. Therefore, erosion resistance can be improved, and the spark discharge gap can be maintained.

The aforementioned area S may be determined as follows. Specifically, the electrode 4 or 7 to which the tip 8 or 9 is bonded is cut along a plane flush with the surface 31 of the electrode 4 or 7 having thereon the bonded tip 8 or 9 (hereinafter the surface 31 may be referred to as the "bonding surface"), and a structural image of the resultant cut surface is taken by means of an SEM (main unit: JSM-6490LA, product of JEOL Ltd., detector: EX-94300S4L1Q, product of JEOL Ltd.), or the cut surface is subjected to mapping analysis. Subsequently, the thus-taken structural image or mapping photograph is subjected to image processing by means of image processing software (e.g., Adobe Photoshop CS), to thereby determine the area of a region defined by the boundary line 33 between the electrode 4 or 7 and the tip 8 or 9 and/or the fused portion 32. In the case where the tip 8 or 9 has such a columnar shape that it extends in a direction perpendicular to the bonding surface 31, or such a spindle-like shape that it has a bottom surface on the bonding surface 31, the area of a region defined by the boundary line 33 between the fused portion 32 and the electrode 4 or 7 may be determined through the following procedure: the electrode 4 or 7 to which the tip 8 or 9 is bonded is not cut (unlike the aforementioned case); the tip 8 or 9 is photographed by means of a digital microscope (VHX-2000, product of Keyence Corporation) from above the electrode 4 or 7 (i.e., in a direction perpendicular to the bonding surface 31); and the resultant photograph is subjected to image processing by means of the aforementioned software (e.g., Photoshop).

The tip 8 or 9 contains Ni, the element group M, and the element group L as appropriate (total amount thereof: 94 mass % or more), and substantially contains the element group S as appropriate. The tip contains these components such that the amounts of the respective components fall within the aforementioned ranges, and the total amount of these components and a component other than the aforementioned ones (e.g., Co, Fe, Re, Mo, or Ta) or an inevitable impurity is 100 mass %. The tip may contain Co, Fe, Re, Mo, Ta, or an inevitable impurity in such an amount that the object of the present invention can be achieved. The total amount of the element group S and such a component may be at most 6 mass %.

The amount of each component contained in the tip 8 or 9 may be determined as follows. Specifically, the tip 8 or 9 is subjected to cutting, and a cross section thereof is exposed. By means of EPMA, WDS (wavelength dispersive X-ray spectrometer) analysis is performed on a plurality of points (e.g., five points) of the cross section of the tip 8 or 9, to thereby determine the mass composition of each point. Subsequently, the values as determined at the points are averaged, and the thus-obtained average value is regarded as the composition of the tip 8 or 9. Notably, measurement is not carried out on the fused portion 32, which is formed through fusion between the tip 8 or 9 and the electrode.

The spark plug 1 is produced through, for example, the following procedure. The tip 8 or 9 may be produced through, for example, a process in which a tip material is prepared by mixing components so that the proportions thereof fall within the aforementioned ranges; the material is melted, and the molten material is processed into a plate material through rolling or a similar technique; and the plate material is formed into tips having a specific shape through punching; or a process in which an alloy is processed into a wire-like or rod-like material through rolling, forging, or wire drawing, and the thus-processed material is longitudinally cut into tips having a specific length. In consideration of the processability of a material employed, a hot or cold process may be appropriately selected for processing of the material.

The center electrode 4 and/or the ground electrode 7 may be produced through, for example, the following process: a molten alloy having an intended composition is prepared by means of a vacuum melting furnace, and the molten alloy is appropriately processed through wire drawing or a similar technique, to thereby produce an electrode material having specific shape and dimensions. The center electrode 4, which has the core inside the outer layer, is formed by inserting an inner member formed of, for example, a Cu alloy having high thermal conductivity into a cup-shaped outer member formed of, for example, an Ni alloy, followed by a plastic working process such as extrusion. In the spark plug 1 of the present embodiment, the ground electrode 7 is formed of a single material. However, as in the case of the center electrode 4, the ground electrode 7 may be formed of an outer layer and a core provided in an axial center portion of the outer layer. In such a case, similar to the case of the center electrode 4, the ground electrode 7 may be produced through the following process: an inner member is inserted into an outer member having a cup shape, and then the resultant product is subjected to a plastic working process (e.g., extrusion), followed by plastic working for forming the product into a generally rectangular columnar shape.

Subsequently, one end portion of the ground electrode 7 is bonded, through electric resistance welding, laser welding, or a similar technique, to the end surface of the metallic shell 6 formed to have a specific shape through, for example, plastic working. Then, the metallic shell 6 having the ground electrode 7 bonded thereto is subjected to Zn plating or Ni plating. Trivalent chromate treatment may be carried out after Zn plating or Ni plating. The plating film formed on the ground electrode may be removed.

Next, the above-produced tip 8 or 9 is fusion-bonded to the ground electrode 7 or the center electrode 4 through, for example, resistance welding and/or laser welding. When the tip 8 or 9 is bonded to the ground electrode 7 and/or the center electrode 4 through resistance welding, for example, the tip 8 or 9 is placed on a specific position of the ground electrode 7 and/or the center electrode 4, and resistance welding is carried out while the tip is pressed onto the specific position. Meanwhile, when the tip 8 or 9 is bonded to the ground electrode 7 and/or the center electrode 4 through laser welding, for example, the tip 8 or 9 is placed on a specific position of the ground electrode 7 and/or the center electrode 4, and a laser beam is radiated in an obliquely downward direction with respect to the tip 8 or 9 so that the laser beam is applied to a portion or the entirety of the contact portion between the tip 8 or 9 and the ground electrode 7 and/or the center electrode 4. Laser welding may be carried out after resistance welding.

Separately, the insulator 3 having a specific shape is formed through firing of, for example, a ceramic material. The center electrode 4 having the tip 8 bonded thereto is inserted into the axial hole 2 of the insulator 3, and glass powder for forming the sealing bodies 10 and 11, a resistor composition for forming the resistor 12, and the aforementioned glass powder are sequentially charged into the axial hole 2 under preliminary compression. Subsequently, while the terminal shell 5 is pressed into the axial hole 2 through its end, the resistor composition and the glass powder are pressure-heated. Thus, the resistor composition and the glass powder are sintered, to thereby form the resistor 12 and the sealing bodies 10 and 11. Next, the insulator 3 having the center electrode 4, etc. fixed thereto is assembled into the metallic shell 6 having the ground electrode 7 bonded thereto. Finally, the distal end portion of the ground electrode 7 is bent toward the center electrode 4 such that one end of the ground electrode 7 faces the front end portion of the center electrode 4, to thereby produce the spark plug 1.

The spark plug 1 of the present invention is employed as an ignition plug of an internal combustion engine for an automobile (e.g., a gasoline engine). When in use, the spark plug 1 is fixed to a specific position by screwing the threaded portion 17 into a threaded hole provided on a head (not illustrated) for compartmenting the combustion chamber of the internal combustion engine. The spark plug 1 of the present invention can be applied to any internal combustion engine. Even when the amount of a rare and expensive noble metal is reduced, the erosion resistance of the tip 8 or 9 can be maintained in a cooling/heating cycle environment, and the spark discharge gap can be maintained.

The spark plug 1 of the present invention is not limited to the aforementioned embodiments, and various modifications may be made, so long as the object of the present invention can be achieved. For example, the spark plug 1 is configured such that the front end surface of the center electrode 4 faces the outer peripheral surface of the distal end portion of the ground electrode 7 in the direction of the axis O via the spark discharge gap G. However, the spark plug of the present invention may be configured such that a side surface of the center electrode faces the distal end surface of the ground electrode in a radial direction of the center electrode via the spark discharge gap. In such a case, a single ground electrode or a plurality of ground electrodes may be provided so as to face the side surface of the center electrode.

EXAMPLES

Preparation of Spark Plug Test Sample

A tip material having a specific composition was provided and melted to thereby prepare a molten material, and the molten material was processed into a rectangular columnar material through forging. The rectangular columnar material was processed into a round wire material through, for example, rolling and wire drawing, and the thus-processed material was cut, to thereby form circular columnar tips having a specific length. A center electrode and a ground electrode were formed through the aforementioned processes. Specifically, a molten alloy having a specific composition was prepared, and the molten alloy was appropriately processed, through wire drawing or a similar technique, to thereby produce an electrode material having specific shape and dimensions. Thus, there were produced a center electrode including an outer layer formed of an Ni alloy and a core formed of a Cu alloy; and a ground electrode formed of an Ni alloy.

Subsequently, the ground electrode was bonded to one end surface of a metallic shell, and one of the above-produced tips was bonded, through resistance welding, to the end portion of the ground electrode to which the metallic shell was not bonded. The other tip was bonded to the front end portion of the center electrode through laser welding. Separately, an insulator having a specific shape was prepared through firing of a ceramic material, and the center electrode having the tip bonded thereto was inserted into an axial hole of the insulator. Then, glass powder, a resistor composition, and glass powder were sequentially charged into the axial hole. Finally, a terminal shell was inserted into the axial hole, and seal-fixed to the insulator.

Next, the insulator having the center electrode fixed thereto was assembled into the metallic shell having the ground electrode bonded thereto. Finally, the distal end portion of the ground electrode was bent toward the center electrode so that the tip bonded to the ground electrode faced the tip bonded to the front end surface of the center electrode, to thereby produce a spark plug test sample.

The thread diameter of the thus-produced spark plug test sample was M12, and the spark discharge gap G; i.e., the shortest distance between the tips, was 1.1 mm. The diameter and height of each tip were 0.7 mm and 1.2 mm, respectively. The area S determined through the below-described procedure was 0.43 $mm^2$.

For determination of the area S, the tip was photographed by means of a digital microscope (VHX-2000, product of Keyence Corporation) in a direction perpendicular to the bonding surface of the electrode having the tip bonded thereto. The thus-photographed image was employed for determining the area of a region defined by a boundary line between the electrode and a fused portion formed through fusion between the electrode and the tip during laser welding.

The mass composition of each tip shown in Tables 1 to 3 was determined by means of EPMA (JXA-8500F, product of JEOL Ltd.) through WDS analysis (acceleration voltage: 20 kV, spot diameter: 100 μm). Firstly, the tip was subjected to cutting, and a cross section thereof was exposed. WDS analysis was performed on any five points of the cross section of the tip, to thereby determine the mass composition of each point. Subsequently, the values as determined at the five points were averaged, and the thus-obtained average value was regarded as the composition of the tip.

Table Test for Evaluation of Erosion Resistance

The above-produced spark plug test sample was attached to a high-pressure chamber (pressure condition: 0.6 MPa, nitrogen flow rate: 0.5 L/minute), and discharge was carried out at a frequency of 100 Hz for 250 hours. Before and after this test, the volume of the tip bonded to the ground electrode was measured by means of a projector (TOSCANER-32250μhd, product of Toshiba Corporation, measured at 170 kV and 100 μA). The erosion volume of the tip was determined by subtracting the tip volume as measured after the test from the tip volume as measured before the test. Erosion volume ratio (i.e., the erosion volume of the tip/the erosion volume of pure Ni (taken as 1)) was determined, and spark erosion resistance was evaluated according to the following criteria:

0: erosion volume ratio of 0.95 or more;

1: erosion volume ratio of 0.85 or more and less than 0.95;

2: erosion volume ratio of 0.75 or more and less than 0.85; and

3: erosion volume ratio of less than 0.75.

The results are shown in Tables 1 to 3.

Actual Machine Durability Test

The above-produced spark plug test sample was subjected to a durability test. Specifically, the test sample was attached to an engine for the test (displacement: 2,000 cc, six-cylinder engine). The engine was operated in a full throttle state for one minute, and then idling was performed for one minute. This operation cycle was repeatedly carried out for 100 hours.

Evaluation of Protrusion

Figure 4:
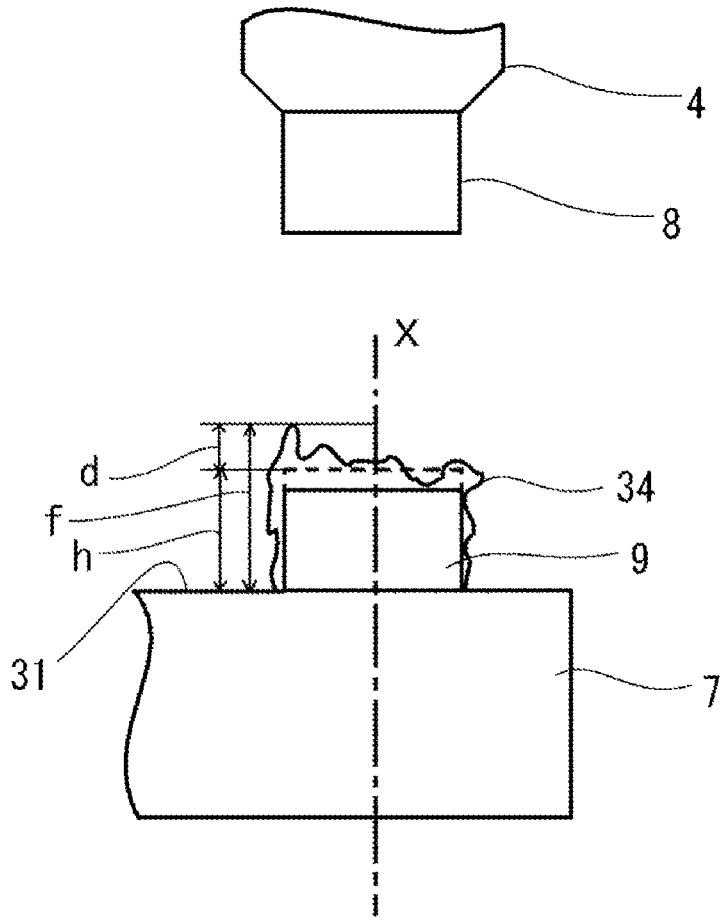
FIG. 4 illustrates the height of a protrusion before and after an actual machine durability test.

The contour of the tip bonded to the ground electrode was traced by means of the aforementioned projector before the actual machine durability test. Every 25 hours after initiation of the engine operation, the contour of the tip was traced, and the corresponding trace image was obtained. FIG. 4 illustrates the height of a protrusion before and after the actual machine durability test. As shown in FIG. 4, firstly, the distance h between the bonding surface of the ground electrode and a front end surface (dotted line) in direction X perpendicular to the bonding surface was measured by use of the trace image before the actual machine durability test. Subsequently, every 25 hours after initiation of the actual machine durability test, the distance f between the bonding surface of the ground electrode and the tip end of a protrusion in direction X was measured by use of the corresponding trace image, and the greatest value of the thus-measured distances was employed for evaluation. Protrusion length d was determined by calculating the difference between the employed distance f and the distance h. Evaluation was carried out according to the following criteria:

0: protrusion length of 0.50 mm or more;

1: protrusion length of 0.45 mm or more and less than 0.50 mm;

2: protrusion length of 0.40 mm or more and less than 0.45 mm;

3: protrusion length of 0.35 mm or more and less than 0.40 mm;

4: protrusion length of 0.20 mm or more and less than 0.35 mm;

5: protrusion length of 0.10 mm or more and less than 0.20 mm;

6: protrusion length of 0.05 mm or more and less than 0.10 mm; and

7: protrusion length of less than 0.05 mm.

The results are shown in Tables 1 to 3.

Evaluation of Erosion Resistance

The volume of the tip bonded to the ground electrode was measured before and after the actual machine durability test by means of the aforementioned projector. The ratio of the tip volume after the test to the tip volume before the test (i.e., erosion volume ratio) was calculated, and the erosion volume ratio was employed for evaluation. The erosion resistance of the tip was evaluated according to the following criteria:

0: erosion volume ratio of 0.95 or more;

1: erosion volume ratio of 0.85 or more and less than 0.95;

2: erosion volume ratio of 0.75 or more and less than 0.85;

3: erosion volume ratio of 0.70 or more and less than 0.75; and

4: erosion volume ratio of less than 0.70.

The results are shown in Tables 1 to 3.

TABLE 1

| | | Composition of tip (mass %) | | | | | | | | Evaluation results | | | |
|---|---|---|---|---|---|---|---|---|---|---|---|---|---|
| | | | Element group M | | Element group L | | | | | Table test | Actual machine durability test | | |
| | | | | | | | | | | Spark erosion | | Erosion | Determination |
| No. | | Ni | Pt | Rh | Ir | Ru | Pd | M + L | Ni + M + L | resistance | Protrusion | resistance | score |
| 1 | Comp. | 100.0 | | | | | | 0.0 | 100.0 | 0 | 0 | 0 | 0 |
| 2 | Ex. | 98.0 | 2.0 | | | | | 2.0 | 100.0 | 1 | 0 | 0 | 0 |
| 3 | | 97.5 | 2.5 | | | | | 2.5 | 100.0 | 2 | 0 | 0 | 0 |
| 4 | Ex. | 97.0 | 3.0 | | | | | 3.0 | 100.0 | 2 | 2 | 2 | 4 |
| 5 | | 96.0 | 4.0 | | | | | 4.0 | 100.0 | 2 | 2 | 2 | 4 |
| 6 | | 95.0 | 5.0 | | | | | 5.0 | 100.0 | 2 | 3 | 2 | 5 |
| 7 | | 90.0 | 10.0 | | | | | 10.0 | 100.0 | 2 | 3 | 2 | 5 |

TABLE 1-continued

| No. | | Composition of tip (mass %) Ni | Element group M Pt | Rh | Element group L Ir | Ru | Pd | M + L | Ni + M + L | Evaluation results: Table test Spark erosion resistance | Actual machine durability test Protrusion | Erosion resistance | Determination score |
|---|---|---|---|---|---|---|---|---|---|---|---|---|---|
| 8 | | 80.0 | 20.0 | | | | | 20.0 | 100.0 | 2 | 3 | 2 | 5 |
| 9 | | 70.0 | 30.0 | | | | | 30.0 | 100.0 | 2 | 3 | 2 | 5 |
| 10 | | 68.0 | 32.0 | | | | | 32.0 | 100.0 | 2 | 2 | 2 | 4 |
| 11 | | 65.0 | 35.0 | | | | | 35.0 | 100.0 | 2 | 2 | 2 | 4 |
| 12 | Comp. | 60.0 | 40.0 | | | | | 40.0 | 100.0 | 2 | 0 | 1 | 0 |
| 13 | Ex. | 98.0 | | 2.0 | | | | 2.0 | 100.0 | 2 | 0 | 0 | 0 |
| 14 | Ex. | 97.0 | | 3.0 | | | | 3.0 | 100.0 | 2 | 2 | 2 | 4 |
| 15 | | 95.0 | | 5.0 | | | | 5.0 | 100.0 | 2 | 3 | 2 | 5 |
| 16 | | 90.0 | | 10.0 | | | | 10.0 | 100.0 | 2 | 3 | 2 | 5 |
| 17 | | 70.0 | | 30.0 | | | | 30.0 | 100.0 | 2 | 3 | 2 | 5 |
| 18 | | 65.0 | | 35.0 | | | | 35.0 | 100.0 | 2 | 2 | 2 | 4 |
| 19 | Comp. Ex. | 60.0 | | 40.0 | | | | 40.0 | 100.0 | 2 | 0 | 1 | 0 |
| 20 | Ex. | 97.0 | 1.0 | 2.0 | | | | 3.0 | 100.0 | 2 | 2 | 2 | 4 |
| 21 | | 95.0 | 3.0 | 2.0 | | | | 5.0 | 100.0 | 2 | 3 | 2 | 5 |
| 22 | | 70.0 | 20.0 | 10.0 | | | | 30.0 | 100.0 | 2 | 3 | 2 | 5 |
| 23 | | 65.0 | 20.0 | 15.0 | | | | 35.0 | 100.0 | 2 | 2 | 2 | 4 |
| 24 | | 96.5 | 3.0 | | 0.5 | | | 3.5 | 100.0 | 2 | 2 | 2 | 4 |
| 25 | | 96.0 | 3.0 | | 1.0 | | | 4.0 | 100.0 | 3 | 2 | 3 | 5 |
| 26 | | 94.0 | 3.0 | | 3.0 | | | 6.0 | 100.0 | 3 | 2 | 3 | 5 |
| 27 | | 90.0 | 3.0 | | 7.0 | | | 10.0 | 100.0 | 3 | 2 | 3 | 5 |
| 28 | | 87.0 | 3.0 | | 10.0 | | | 13.0 | 100.0 | 3 | 2 | 3 | 5 |
| 29 | | 85.0 | 3.0 | | 12.0 | | | 15.0 | 100.0 | 3 | 1 | 3 | 4 |
| 30 | | 82.0 | 3.0 | | 15.0 | | | 18.0 | 100.0 | 3 | 1 | 3 | 4 |
| 31 | Comp. Ex. | 77.0 | 3.0 | | 20.0 | | | 23.0 | 100.0 | 3 | 0 | 2 | 0 |
| 32 | Ex. | 85.0 | 5.0 | | 10.0 | | | 15.0 | 100.0 | 3 | 3 | 3 | 6 |
| 33 | | 75.0 | 5.0 | | 20.0 | | | 25.0 | 100.0 | 3 | 0 | 2 | 0 |
| 34 | | 80.0 | 10.0 | | 10.0 | | | 20.0 | 100.0 | 3 | 3 | 3 | 6 |
| 35 | | 70.0 | 20.0 | | 10.0 | | | 30.0 | 100.0 | 3 | 3 | 3 | 6 |
| 36 | | 65.0 | 25.0 | | 10.0 | | | 35.0 | 100.0 | 3 | 2 | 3 | 5 |
| 37 | | 65.0 | 30.0 | | 5.0 | | | 35.0 | 100.0 | 3 | 2 | 3 | 5 |
| 38 | | 65.0 | 20.0 | | 15.0 | | | 35.0 | 100.0 | 3 | 1 | 3 | 4 |
| 39 | Comp. | 60.0 | 30.0 | | 10.0 | | | 40.0 | 100.0 | 3 | 0 | 2 | 0 |
| 40 | Ex. | 60.0 | 25.0 | | 15.0 | | | 40.0 | 100.0 | 3 | 0 | 2 | 0 |
| 41 | Ex. | 96.0 | 3.0 | | | 1.0 | | 4.0 | 100.0 | 3 | 2 | 3 | 5 |
| 42 | | 87.0 | 3.0 | | | 10.0 | | 13.0 | 100.0 | 3 | 2 | 3 | 5 |
| 43 | | 82.0 | 3.0 | | | 15.0 | | 18.0 | 100.0 | 3 | 1 | 3 | 4 |
| 44 | | 96.0 | 3.0 | | | | 1.0 | 4.0 | 100.0 | 3 | 2 | 3 | 5 |
| 45 | | 87.0 | 3.0 | | | | 10.0 | 13.0 | 100.0 | 3 | 2 | 3 | 5 |
| 46 | | 82.0 | 3.0 | | | | 15.0 | 18.0 | 100.0 | 3 | 1 | 3 | 4 |
| 47 | | 91.0 | 3.0 | | 2.0 | 2.0 | 2.0 | 9.0 | 100.0 | 3 | 2 | 3 | 5 |

TABLE 2

| No. | | Composition of tip (mass %) Ni | Element group M Pt | Rh | Element group L Ir | Ru | Pd | M + L | Ni + M + L | Element group S Si | Ti | Al | Cr | Mn | Trace element Co | Fe | Re | W | S + trace element | Evaluation results: Table test Spark erosion resistance | Actual machine durability test Protrusion | Erosion resistance | Determination score |
|---|---|---|---|---|---|---|---|---|---|---|---|---|---|---|---|---|---|---|---|---|---|---|---|
| 48 | Comp. Ex. | 97.7 | | | | | | 0.0 | 97.7 | 1.0 | 0.1 | 0.1 | 0.1 | 1.0 | | | | | 2.3 | 0 | 1 | 0 | 0 |
| 49 | Ex. | 64.9 | 35.0 | | | | | 35.0 | 99.9 | 0.1 | | | | | | | | | 0.1 | 1 | 2 | 2 | 4 |
| 50 | | 64.8 | 35.0 | | | | | 35.0 | 99.8 | 0.2 | | | | | | | | | 0.2 | 2 | 3 | 2 | 5 |
| 51 | | 64.6 | 35.0 | | | | | 35.0 | 99.6 | 0.4 | | | | | | | | | 0.4 | 2 | 3 | 2 | 5 |
| 52 | | 64.5 | 35.0 | | | | | 35.0 | 99.5 | 0.5 | | | | | | | | | 0.5 | 2 | 4 | 2 | 6 |
| 53 | | 64.0 | 35.0 | | | | | 35.0 | 99.0 | 1.0 | | | | | | | | | 1.0 | 2 | 4 | 2 | 6 |
| 54 | | 63.0 | 35.0 | | | | | 35.0 | 98.0 | 2.0 | | | | | | | | | 2.0 | 2 | 4 | 2 | 6 |
| 55 | | 62.5 | 35.0 | | | | | 35.0 | 97.5 | 2.5 | | | | | | | | | 2.5 | 2 | 4 | 2 | 6 |

TABLE 2-continued

| | | Composition of tip (mass %) | | | | | | | | | | | | | | | | | | Evaluation results | | | |
|---|---|---|---|---|---|---|---|---|---|---|---|---|---|---|---|---|---|---|---|---|---|---|---|
| | | | Element group M | | Element group L | | | M + | Ni + M + | Element group S | | | | | Trace element | | | | S + trace ele- | Table test Spark erosion resist- | Actual machine durability test Pro-tru- | Actual machine durability test Erosion resist- | Deter-mina-tion |
| No. | | Ni | Pt | Rh | Ir | Ru | Pd | L | L | Si | Ti | Al | Cr | Mn | Co | Fe | Re | W | ment | ance | sion | ance | score |
| 56 | | 62.0 | 35.0 | | | | | 35.0 | 97.0 | 3.0 | | | | | | | | | 3.0 | 2 | 4 | 2 | 6 |
| 57 | | 61.0 | 35.0 | | | | | 35.0 | 96.0 | 4.0 | | | | | | | | | 4.0 | 1 | 4 | 1 | 5 |
| 58 | | 59.0 | 35.0 | | | | | 35.0 | 94.0 | 6.0 | | | | | | | | | 6.0 | 1 | 4 | 1 | 5 |
| 59 | Comp. Ex. | 58.0 | 35.0 | | | | | 35.0 | 93.0 | 7.0 | | | | | | | | | 7.0 | 0 | 4 | 0 | 0 |
| 60 | Ex. | 64.8 | 35.0 | | | | | 35.0 | 99.8 | | 0.2 | | | | | | | | 0.2 | 2 | 3 | 2 | 5 |
| 61 | | 64.5 | 35.0 | | | | | 35.0 | 99.5 | | 0.5 | | | | | | | | 0.5 | 2 | 4 | 2 | 6 |
| 62 | | 64.0 | 35.0 | | | | | 35.0 | 99.0 | | 1.0 | | | | | | | | 1.0 | 2 | 4 | 2 | 6 |
| 63 | | 62.0 | 35.0 | | | | | 35.0 | 97.0 | | 3.0 | | | | | | | | 3.0 | 2 | 4 | 2 | 6 |
| 64 | | 59.0 | 35.0 | | | | | 35.0 | 94.0 | | 6.0 | | | | | | | | 6.0 | 1 | 4 | 1 | 5 |
| 65 | | 64.8 | 35.0 | | | | | 35.0 | 99.8 | | | 0.2 | | | | | | | 0.2 | 2 | 3 | 2 | 5 |
| 66 | | 64.5 | 35.0 | | | | | 35.0 | 99.5 | | | 0.5 | | | | | | | 0.5 | 2 | 4 | 2 | 6 |
| 67 | | 64.0 | 35.0 | | | | | 35.0 | 99.0 | | | 1.0 | | | | | | | 1.0 | 2 | 4 | 2 | 6 |
| 68 | | 62.0 | 35.0 | | | | | 35.0 | 97.0 | | | 3.0 | | | | | | | 3.0 | 2 | 4 | 2 | 6 |
| 69 | | 59.0 | 35.0 | | | | | 35.0 | 94.0 | | | 6.0 | | | | | | | 6.0 | 1 | 4 | 1 | 5 |
| 70 | Comp. Ex. | 58.0 | 35.0 | | | | | 35.0 | 93.0 | | | 7.0 | | | | | | | 7.0 | 0 | 4 | 0 | 0 |
| 71 | Ex. | 64.8 | 35.0 | | | | | 35.0 | 99.8 | | | | 0.2 | | | | | | 0.2 | 2 | 3 | 2 | 5 |
| 72 | | 64.5 | 35.0 | | | | | 35.0 | 99.5 | | | | 0.5 | | | | | | 0.5 | 2 | 4 | 2 | 6 |
| 73 | | 62.0 | 35.0 | | | | | 35.0 | 97.0 | | | | 3.0 | | | | | | 3.0 | 2 | 4 | 2 | 6 |
| 74 | | 64.8 | 35.0 | | | | | 35.0 | 99.8 | | | | | 0.2 | | | | | 0.2 | 2 | 3 | 2 | 5 |
| 75 | | 62.0 | 35.0 | | | | | 35.0 | 97.0 | | | | | 3.0 | | | | | 3.0 | 2 | 4 | 2 | 6 |
| 76 | | 64.8 | 35.0 | | | | | 35.0 | 99.8 | 0.1 | 0.1 | | | | | | | | 0.2 | 2 | 3 | 2 | 5 |
| 77 | | 64.5 | 35.0 | | | | | 35.0 | 99.5 | 0.1 | 0.1 | 0.1 | 0.1 | 0.1 | | | | | 0.5 | 2 | 4 | 2 | 6 |
| 78 | | 62.0 | 35.0 | | | | | 35.0 | 97.0 | 0.5 | 0.5 | 1.0 | 0.5 | 0.5 | | | | | 3.0 | 2 | 4 | 2 | 6 |
| 79 | | 59.0 | 35.0 | | | | | 35.0 | 94.0 | 0.5 | 0.5 | 2.0 | 1.5 | 1.5 | | | | | 6.0 | 1 | 4 | 1 | 5 |

TABLE 3

| | | Composition of tip (mass %) | | | | | | | | | | | | | | | | | | Evaluation results | | | |
|---|---|---|---|---|---|---|---|---|---|---|---|---|---|---|---|---|---|---|---|---|---|---|---|
| | | | Element group M | | Element group L | | | M + | Ni + M + | Element group S | | | | | Trace element | | | | S + trace ele- | Table test Spark erosion resist- | Actual machine durability test Pro-tru- | Actual machine durability test Ero-sion re-sist- | De-ter-mina-tion |
| No. | | Ni | Pt | Rh | Ir | Ru | Pd | L | L | Si | Ti | Al | Cr | Mn | Co | Fe | Re | W | ment | ance | sion | ance | score |
| 80 | Comp. Ex. | 97.3 | 2.5 | | | | | 2.5 | 99.8 | 0.2 | | | | | | | | | 0.2 | 2 | 0 | 0 | 0 |
| 81 | Ex. | 96.8 | 3.0 | | | | | 3.0 | 99.8 | 0.2 | | | | | | | | | 0.2 | 2 | 3 | 2 | 5 |
| 82 | | 94.8 | 5.0 | | | | | 5.0 | 99.8 | 0.2 | | | | | | | | | 0.2 | 2 | 4 | 2 | 6 |
| 83 | | 89.8 | 10.0 | | | | | 10.0 | 99.8 | 0.2 | | | | | | | | | 0.2 | 2 | 4 | 2 | 6 |
| 84 | | 69.8 | 30.0 | | | | | 30.0 | 99.8 | 0.2 | | | | | | | | | 0.2 | 2 | 4 | 2 | 6 |
| 85 | | 64.8 | 35.0 | | | | | 35.0 | 99.8 | 0.2 | | | | | | | | | 0.2 | 2 | 3 | 2 | 5 |
| 86 | Comp. Ex. | 59.8 | 40.0 | | | | | 40.0 | 99.8 | 0.2 | | | | | | | | | 0.2 | 2 | 0 | 2 | 0 |
| 87 | Ex. | 89.5 | 10.0 | | | | | 10.0 | 99.5 | 0.5 | | | | | | | | | 0.5 | 2 | 5 | 3 | 8 |
| 88 | | 89.5 | 10.0 | | | | | 10.0 | 99.5 | | | 0.5 | | | | | | | 0.5 | 2 | 5 | 3 | 8 |
| 89 | | 89.5 | 10.0 | | | | | 10.0 | 99.5 | 0.1 | 0.1 | 0.1 | 0.1 | 0.1 | | | | | 0.5 | 2 | 5 | 3 | 8 |
| 90 | | 88.8 | 10.0 | | | | | 10.0 | 98.8 | 1.0 | 0.1 | 0.1 | | | | | | | 1.2 | 2 | 5 | 3 | 8 |
| 91 | | 87.0 | 10.0 | | | | | 10.0 | 97.0 | 3.0 | | | | | | | | | 3.0 | 2 | 5 | 3 | 8 |
| 92 | | 84.0 | 10.0 | | | | | 10.0 | 94.0 | 6.0 | | | | | | | | | 6.0 | 1 | 5 | 1 | 6 |
| 93 | | 84.0 | 10.0 | | | | | 10.0 | 94.0 | 2.0 | 1.0 | 1.0 | 1.0 | 1.0 | | | | | 6.0 | 1 | 5 | 1 | 6 |
| 94 | | 84.8 | 10.0 | | 5.0 | | | 15.0 | 99.8 | 0.2 | | | | | | | | | 0.2 | 3 | 4 | 3 | 7 |
| 95 | | 84.0 | 10.0 | | 5.0 | | | 15.0 | 99.0 | 1.0 | | | | | | | | | 1.0 | 3 | 5 | 4 | 9 |
| 96 | | 96.8 | | 3.0 | | | | 3.0 | 99.8 | 0.2 | | | | | | | | | 0.2 | 2 | 3 | 2 | 5 |
| 97 | | 94.8 | | 5.0 | | | | 5.0 | 99.8 | 0.2 | | | | | | | | | 0.2 | 2 | 4 | 2 | 6 |
| 98 | | 89.8 | | 10.0 | | | | 10.0 | 99.8 | 0.2 | | | | | | | | | 0.2 | 2 | 4 | 2 | 6 |
| 99 | | 89.5 | | 10.0 | | | | 10.0 | 99.5 | 0.5 | | | | | | | | | 0.5 | 2 | 5 | 3 | 8 |

TABLE 3-continued

| | | Composition of tip (mass %) | | | | | | | | | | | | | | | | | | Evaluation results | | | |
|---|---|---|---|---|---|---|---|---|---|---|---|---|---|---|---|---|---|---|---|---|---|---|---|
| | | | Element group M | | Element group L | | | M + | Ni + M + | Element group S | | | | | Trace element | | | | S + trace ele- | Table test | Actual machine durability test | | |
| No. | | Ni | Pt | Rh | Ir | Ru | Pd | L | L | Si | Ti | Al | Cr | Mn | Co | Fe | Re | W | ment | Spark erosion resist-ance | Pro-tru-sion | Ero-sion re-sist-ance | De-ter-mina-tion score |
| 100 | | 69.8 | | 30.0 | | | | 30.0 | 99.8 | 0.2 | | | | | | | | | 0.2 | 2 | 4 | 2 | 6 |
| 101 | | 64.8 | | 35.0 | | | | 35.0 | 99.8 | 0.2 | | | | | | | | | 0.2 | 2 | 3 | 2 | 5 |
| 102 | | 64.8 | | 35.0 | | | | 35.0 | 99.8 | | | 0.2 | | | | | | | 0.2 | 2 | 3 | 2 | 5 |
| 103 | | 64.5 | | 35.0 | | | | 35.0 | 99.5 | 0.5 | | | | | | | | | 0.5 | 2 | 4 | 2 | 6 |
| 104 | | 62.0 | | 35.0 | | | | 35.0 | 97.0 | 3.0 | | | | | | | | | 3.0 | 2 | 4 | 2 | 6 |
| 105 | | 59.0 | | 35.0 | | | | 35.0 | 94.0 | 6.0 | | | | | | | | | 6.0 | 1 | 4 | 1 | 5 |
| 106 | | 64.8 | 15.0 | 20.0 | | | | 35.0 | 99.8 | 0.2 | | | | | | | | | 0.2 | 2 | 3 | 2 | 5 |
| 107 | | 96.0 | 3.0 | | | | | 3.0 | 99.0 | | | | | | 1.0 | | | | 1.0 | 2 | 2 | 2 | 4 |
| 108 | | 94.0 | 3.0 | | | | | 3.0 | 97.0 | | | | | | 3.0 | | | | 3.0 | 2 | 2 | 2 | 4 |
| 109 | | 91.0 | 3.0 | | | | | 3.0 | 94.0 | | | | | | 6.0 | | | | 6.0 | 2 | 2 | 2 | 4 |
| 110 | Comp. Ex. | 90.0 | 3.0 | | | | | 3.0 | 93.0 | | | | | | 7.0 | | | | 7.0 | 0 | 2 | 0 | 0 |
| 111 | Ex. | 94.8 | 3.0 | | | | | 3.0 | 97.8 | 0.2 | | | | | 1.0 | 1.0 | | | 2.2 | 2 | 3 | 2 | 5 |
| 112 | | 94.0 | 3.0 | | | | | 3.0 | 97.0 | 0.5 | | | | | 1.0 | | 1.0 | 0.5 | 3.0 | 2 | 4 | 2 | 6 |
| 113 | | 91.0 | 3.0 | | | | | 3.0 | 94.0 | 4.0 | | | | | 0.5 | 0.5 | 0.5 | 0.5 | 6.0 | 1 | 4 | 1 | 5 |
| 114 | Comp. Ex. | 90.0 | 3.0 | | | | | 3.0 | 93.0 | 4.0 | | | | | 1.0 | 1.0 | 1.0 | | 7.0 | 0 | 4 | 0 | 0 |

Evaluation in Association with Different Areas S

A spark plug test sample was produced in the same manner as in the aforementioned spark plug test sample production method, except that the diameter and height of a circular columnar tip were changed. The thus-produced test sample was subjected to the actual machine durability test, and evaluation of protrusion and erosion resistance was carried out in the same manner as described above. The results are shown in Table 4.

TABLE 4

| Dimensions | | | Test No. (composition of tip) | | | | | | | | |
|---|---|---|---|---|---|---|---|---|---|---|---|
| | | | No. 12 (Ni—40Pt) | | | No. 4 (Ni—3Pt) | | | No. 82 (Ni—3Pt—0.2Si) | | |
| | | | Actual machine durability test | | | Actual machine durability test | | | Actual machine durability test | | |
| Tip height (mm) | Tip diameter (mm) | Area S ($mm^2$) | Protrusion | Erosion resistance | Determination score | Protrusion | Erosion resistance | Determination score | Protrusion | Erosion resistance | Determination score |
| 0.8 | 0.7 | 0.4 | 0 | 1 | 0 | 2 | 2 | 4 | 3 | 2 | 5 |
| 0.8 | 0.8 | 0.5 | 0 | 1 | 0 | 2 | 2 | 4 | 3 | 2 | 5 |
| 0.8 | 0.9 | 0.7 | 0 | 1 | 0 | 3 | 2 | 5 | 4 | 2 | 6 |
| 0.8 | 1.1 | 1.0 | 0 | 1 | 0 | 3 | 2 | 5 | 4 | 2 | 6 |
| 0.8 | 1.2 | 1.2 | 0 | 1 | 0 | 4 | 2 | 6 | 5 | 3 | 8 |
| 0.5 | 1.5 | 1.8 | 0 | 1 | 0 | 4 | 2 | 6 | 5 | 3 | 8 |
| 0.8 | 1.5 | 1.8 | 0 | 1 | 0 | 4 | 2 | 6 | 5 | 3 | 8 |
| 1.0 | 1.5 | 1.8 | 0 | 1 | 0 | 4 | 2 | 6 | 5 | 3 | 8 |
| 0.8 | 1.8 | 2.6 | 0 | 1 | 0 | 4 | 2 | 6 | 5 | 3 | 8 |

| Dimensions | | | Test No. (composition of tip) | | | | | |
|---|---|---|---|---|---|---|---|---|
| | | | No. 7 (Ni—10Pt) | | | No. 91 (Ni—10Pt—1Si—0.1Ti—0.1Al) | | |
| | | | Actual machine durability test | | | Actual machine durability test | | |
| Tip height (mm) | Tip diameter (mm) | Area S ($mm^2$) | Protrusion | Erosion resistance | Determination score | Protrusion | Erosion resistance | Determination score |
| 0.8 | 0.7 | 0.4 | 3 | 2 | 5 | 5 | 3 | 8 |
| 0.8 | 0.8 | 0.5 | 3 | 2 | 5 | 5 | 3 | 8 |
| 0.8 | 0.9 | 0.7 | 4 | 2 | 6 | 6 | 3 | 9 |
| 0.8 | 1.1 | 1.0 | 4 | 2 | 6 | 6 | 3 | 9 |
| 0.8 | 1.2 | 1.2 | 5 | 2 | 7 | 7 | 4 | 11 |

TABLE 4-continued

| | | | | | | | | |
|---|---|---|---|---|---|---|---|---|
| 0.5 | 1.5 | 1.8 | 5 | 2 | 7 | 7 | 4 | 11 |
| 0.8 | 1.5 | 1.8 | 5 | 2 | 7 | 7 | 4 | 11 |
| 1.0 | 1.5 | 1.8 | 5 | 2 | 7 | 7 | 4 | 11 |
| 0.8 | 1.8 | 2.6 | 5 | 2 | 7 | 7 | 4 | 11 |

Each determination score in Tables 1 to 4 is based on the total of the corresponding values of "evaluation of protrusion" and "evaluation of erosion resistance." When the value of "evaluation of protrusion" or "evaluation of erosion resistance" is "0," the determination score is "0."

As shown in Tables 1 to 3, a spark plug including a tip falling within the scope of the present invention was favorably evaluated in terms of erosion resistance and protrusion. Therefore, the spark discharge gap G was generally maintained throughout the actual machine durability test.

In contrast, as shown in Tables 1 to 3, a spark plug including a tip falling outside the scope of the present invention was poorly evaluated in terms of at least one of erosion resistance and protrusion.

As shown in Table 4, when the area S was 0.7 $mm^2$ or more, formation of a protrusion was further suppressed, whereas when the area S was 1.2 $mm^2$ or more, erosion resistance was further improved.

| Description of Reference Numerals | |
|---|---|
| 1: | spark plug |
| 2: | axial hole |
| 3: | insulator |
| 4: | center electrode |
| 5: | terminal shell |
| 6: | metallic shell |
| 7: | ground electrode |
| 8, 9: | tip |
| 10, 11: | sealing body |
| 12: | resistor |
| 13: | flange portion |
| 14: | rear-end-side body portion |
| 15: | front-end-side body portion |
| 16: | elongated leg portion |
| 17: | threaded portion |
| 18: | gas sealing portion |
| 19: | gasket |
| 20: | tool engagement portion |
| 21: | crimp portion |
| 22, 23: | packing |
| 24: | talc |
| 25: | exposed portion |
| 26: | columnar portion |
| 27: | outer layer |
| 28: | core |
| 31: | surface, bonding surface |
| 32: | fused portion |
| 33: | boundary line |
| 34: | protrusion |
| G: | spark discharge gap |

Having described the invention, the following is claimed:

1. A spark plug comprising a center electrode; a ground electrode provided so as to form a gap between the ground electrode and the center electrode; and a tip provided on at least one of a distal end portion of the ground electrode and a front end portion of the center electrode, the end portions facing each other, characterized in that the tip contains an element group M (M consists of at least one species of Pt and Rh) in an amount of 3 mass % to 35 mass %, and an element group L (L consists of at least one species of Ir, Ru, and Pd) in an amount of 0 mass % to 15 mass %; the total amount of the element group M and the element group L is at most 35 mass %; and the total amount of Ni, the element group M, and the element group L is at least 94 mass %.

2. A spark plug according to claim 1, wherein the tip contains an element group S (S consists of at least one species of Si, Al, Ti, Cr, and Mn) in an amount of 0.2 mass % to 6 mass %.

3. A spark plug according to claim 1 or 2, wherein the tip contains the element group L in an amount of 1 mass % to 10 mass %.

4. A spark plug according to claims 1 or 2, wherein the tip contains the element group M in an amount of 5 mass % to 30 mass %, and the total amount of the element group M and the element group L is at most 30 mass %.

5. A spark plug according to claims 1 or 2, wherein the tip contains the element group S in an amount of 0.5 mass % to 3 mass %.

6. A spark plug according to claims 1 or 2, wherein the tip is bonded to a surface of the ground electrode and/or the center electrode (hereinafter may be referred to as the "electrode") without the intervention of a fused portion formed through fusion between the tip and the electrode or at least a portion of the tip is bonded to the surface with the intervention of the fused portion, and when the electrode to which the tip is bonded is cut along a plane flush with the surface, a region of the cut surface defined by a boundary line between the electrode and the tip and/or the fused portion has an area S of at least 0.7 $mm^2$.

7. A spark plug according to claim 6, wherein the area S is at least 1.2 $mm^2$.

* * * * *